US009965999B1

(12) United States Patent
Barnes

(10) Patent No.: US 9,965,999 B1
(45) Date of Patent: May 8, 2018

(54) ADJUSTING DISPLAY COLOR BASED ON BRIGHTNESS

(71) Applicant: Amazon Technologies, Inc., Reno, NV (US)

(72) Inventor: Christopher Dwight Barnes, Mountain View, CA (US)

(73) Assignee: Amazon Technologies, Inc., Reno, NV (US)

( * ) Notice: Subject to any disclaimer, the term of this patent is extended or adjusted under 35 U.S.C. 154(b) by 0 days. days.

(21) Appl. No.: 14/316,660

(22) Filed: Jun. 26, 2014

(51) Int. Cl.
*G09G 3/32* (2016.01)
*G09G 3/34* (2006.01)
*G09G 3/20* (2006.01)

(52) U.S. Cl.
CPC ..... *G09G 3/32* (2013.01); *G09G 3/2003* (2013.01); *G09G 3/344* (2013.01); *G09G 2320/0666* (2013.01)

(58) Field of Classification Search
None
See application file for complete search history.

(56) References Cited

U.S. PATENT DOCUMENTS 7,348,530 B2 * 3/2008 Cheang ..... G01J 1/04 250/205
2002/0113192 A1 * 8/2002 Antila ..... G09G 3/3413 250/205
2009/0160878 A1 * 6/2009 Kwong ..... G09G 5/00 345/690
2013/0105668 A1 * 5/2013 Ho ..... G09G 3/3413 250/214 AL

* cited by examiner

*Primary Examiner* — David D Davis
(74) *Attorney, Agent, or Firm* — Lee & Hayes, PLLC

(57) ABSTRACT

An electronic device may include a display and a light that may illuminate the display. Based at least partly on preferences of a user that is using the electronic device, a brightness of the display, and/or a brightness of the ambient environment surrounding the electronic device, the color that is being rendered by the display or that is being illuminated on the display may be determined and/or adjusted to a different color. The color may be presented or adjusted by setting or adjusting the power or current being supplied to one or more light-emitting diodes (LEDs) included within the light.

22 Claims, 8 Drawing Sheets

ADJUSTING DISPLAY COLOR BASED ON BRIGHTNESS

BACKGROUND

Many users enjoy entertainment through the consumption of digital content, such as music, movies, images, electronic books, and so on. These users employ various electronic devices to consume such content. Among these electronic devices are electronic book (eBook) reader devices, cellular telephones, personal digital assistants (PDAs), portable media players, tablet computers, and the like. Users read or otherwise view digital content on their devices in varying light conditions. However, the color of the display presented to users is typically the same regardless of who purchases and/or uses the devices. As a result, since users are likely to have different preferences with respect to color, the standard display color may not be aesthetically pleasing to some users, and may detract from the users' experience for a variety of reasons.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
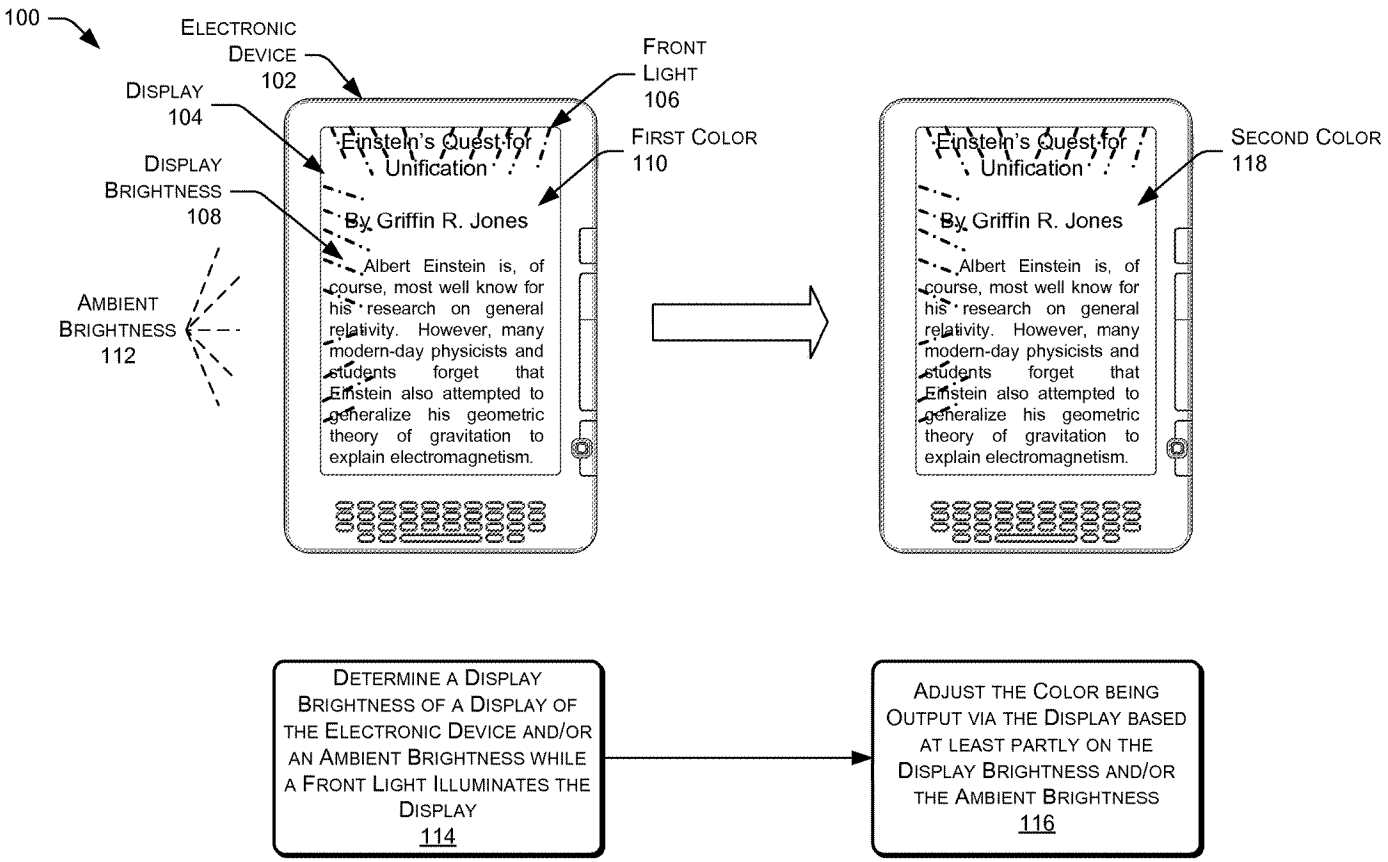
FIG. 1 illustrates an example scenario where the settings of an electronic device are adjusted to cause a display to output a different color utilizing a front light based at least partly on a brightness of the display and/or a brightness of the ambient environment.

This disclosure describes, in part, techniques for adjusting a color of a display of an electronic device utilizing a front light. More particularly, this disclosure describes adjusting the power of one or more light-emitting diodes (LEDs) included within the front light in order to cause the display (e.g., the background of the display) of the electronic device to output a particular color and/or to output a different color.

In various embodiments, the color that is output via the display may be adjusted in response to a user request, and/or based at least partly on a display brightness of the display and/or an ambient brightness of an environment surrounding the electronic device.

Typically, electronic devices are designed such that the color of the display of the electronic devices is standardized, regardless of which user purchases and/or users the electronic devices. However, different users, such as users in different geographic areas, may prefer different colors and/or a different brightness of the display. As a result, due to the varying preferences of users, the standard color of the display likely will not be suitable or preferred by all users. Moreover, even the color preferences of the same user may change over time, and that user may prefer different colors of the display depending upon the brightness of the ambient environment and/or the brightness of the display itself.

Accordingly, the color that is output via the display of the electronic device described herein may be adjusted based at least partly on preferences of the user operating the electronic device, a behavior of that user over time, the brightness of the display, and/or the brightness of the ambient environment surrounding the electronic device. In various embodiments, the front light of the electronic device may include multiple LEDs having varying colors. In order to adjust the color that is output via the display, the power being supplied to one or more of the multiple LEDs may be adjusted, either manually by the user or in a partially or fully automated manner performed by the electronic device. Accordingly, the color of the display that is presented to a first user may be different than a color of another display that is presented to a second user, thereby resulting in a more aesthetically pleasing experience for each user and allowing users to better operate the electronic device.

The techniques described herein may be implemented in a variety of ways and by a variety of electronic devices. While a few examples are illustrated and described below, it is to be appreciated that other electronic devices may implement these techniques. Furthermore, it is noted that because electronic books are structured as virtual frames presented on a computing device, the term "page" as used herein refers to a collection of content presented at one time on a display. Thus, "pages" as described herein are not fixed permanently, and may be redefined or repaginated based on variances in display conditions, such as screen size, font type or size, margins, line spacing, resolution, or the like.

In addition, the term "electronic book", "eBook", "content", or "content item" as used herein, may include any type of content which can be stored and distributed in digital form. By way of illustration, and without limitation, electronic books and content items can include all forms of textual information such as books, magazines, newspapers, newsletters, periodicals, journals, reference materials, telephone books, textbooks, anthologies, proceedings of meetings, forms, directories, maps, manuals, guides, references, photographs, articles, reports, documents, etc., and all forms of audio and audiovisual works such as music, multimedia presentations, audio books, movies, etc.

FIG. 1 illustrates an example scenario 100 where an electronic device adjusts a color of a display while a front light lights the display, thereby causing the display to emit a color that is most likely to be preferred by a user operating the electronic device. The color that is initially displayed and/or the adjustment of the color of the display may be based at least partly on a display brightness of the display and/or an ambient brightness of an environment surrounding the electronic device.

As shown, the electronic device 102 may include a display 104 and a front light 106, or any other type of light, that illuminates the display 104 and/or that adjusts the brightness of the display 104. As a result of the front light 106 lighting the display 104, the display 104 may have a corresponding display brightness 108 (e.g., a display brightness value) that indicates a level of brightness of the display 104. The front light 106 may also cause the display to be presented in a particular color, which may be represented by first color 110. The electronic device 102 may cause the display to output a particular color by adjusting settings of the electronic device 102, such as by adjusting the amount of power that is being supplied to the front light 106 that is illuminating the display 104. In particular, the electronic device 102 may adjust the power that is being supplied to different colored LEDs within the front light 106, such that a first LED having a first color is powered on or is being supplied with a first amount of power, and a second LED having a second, different color is either powered off or is being supplied with a second amount of power that is less than the first amount of power. By adjusting the power being supplied to different LEDs within the front light 106, the color being output via the display 104 may vary. In other embodiments, instead of the front light 106 utilizing LEDs having various colors, the front light 106 may utilize other types of lights. For example, the front light 106, or any other light source described herein, may include one or more fluorescent lights, lights having a phosphor material associated therewith (e.g., a phosphor coating), electrophoretic displays, or any other type of light that may illuminate the display 104.

The electronic device 102 may also include one or more sensors or other mechanisms (e.g., an ambient light sensor, a camera, etc.) for determining an ambient brightness of the environment surrounding the electronic device 102 (e.g., an ambient brightness value), which may be represented by an ambient brightness 112. The sensor(s) may be part of, or separate from, the electronic device 102. In certain embodiments, the first color 110 of the display 104 may be based at least partly on the particular display brightness 108 of the display 104 and/or the ambient brightness 112. That is, the first color 110 may be determined in view of the display brightness 108 and/or the ambient brightness 112 in order to provide an aesthetically pleasing experience for the user and to provide an overall positive experience for the user while using the electronic device 102.

As stated at step 114, the illustrated electronic device determines the display brightness 108 of the display 104 of the electronic device 102 and/or the ambient brightness 108 while the front light 106 lights the display 104. As illustrated, the display 104 currently displays a first page of an electronic book and the front light 106 utilizes a brightness value (e.g., as set by a user) for illuminating the display 104. In this example, the front light 106 is integral with the display 104. For example, the electronic device 102 may include one or more lights (e.g., LEDs) underneath a bezel of the display 104 that emit light across the display 104. In various embodiments, the one or more lights may be situated between the bezel and the display 104 and/or underneath the display 104 when the electronic device 102 is oriented in a vertical (or approximately vertical) position. The display 104 may then be coated with a refractive material that guides the light onto the display 104, thus causing the light to reflect off of and illuminate the display 104.

As stated above, the electronic device 102 may determine the display brightness 108 of the display 104, which may be adjustable by the user or set by the electronic device 102. The display brightness 108 of the display 104 may be based on an extent to which the front light 106 (or another light source) illuminates the display 104. That is, the display brightness 108 may be a setting associated with the electronic device 102 that determines how much light is to illuminate the display 104. This setting may be adjustable by a user, or pre-set or adjusted by the electronic device 102. In addition, the electronic device 102 may determine the ambient brightness 112 of the environment surrounding the electronic device 102. The ambient brightness 112 may be specified by the user operating the electronic device 102 and/or determined by one or more sensors residing on or included within the electronic device 102. The ambient brightness 112 may correspond to the degree of brightness that is within an environment (e.g., a room, the outdoors, etc.) in which the electronic device 102 is included. That is, the ambient brightness 112 may correspond to an amount of incident light associated with the electronic device 102. For instance, the ambient brightness 112 may be relatively high in daylight or in a room with bright lighting conditions, or may be relatively low during the night or in a room with the lights turned off (or with dim lighting conditions).

As stated at step 116, the electronic device 102 may adjust the color being output via the display 104 based at least partly on the display brightness 108 and/or the ambient brightness 116. That is, the electronic device 102 may adjust one or more settings that cause the front light 106 and/or the display 104 to output a particular color and/or a different color. Provided that the front light 106 includes one or more LEDs, or groups/collections of LEDs, the electronic device 102 may adjust the power of one or more of the LEDs, in order to modify or adjust the color of the display 104. As shown, the first color 110 of the display 104 may be adjusted or modified to the second color 118 of the display 104, which may be different from the first color 110. In certain embodiments, the second color 118 may be a variation of, or a different version of, the first color 110. For instance, if the first color 110 is a yellowish color, the second color 118 may be a lighter or darker shade of that yellowish color. The second color 118 of the display 104 may be more appropriate (e.g., aesthetically pleasing) or preferable to the user in view of the current display brightness 108 and/or the current ambient brightness 112. Alternatively, and as stated above, the initial first color 110 of the display 104 need not be adjusted and the first color instead may be determined based at least partly on the current display brightness 108 and/or the current ambient brightness 112.

Figure 2:
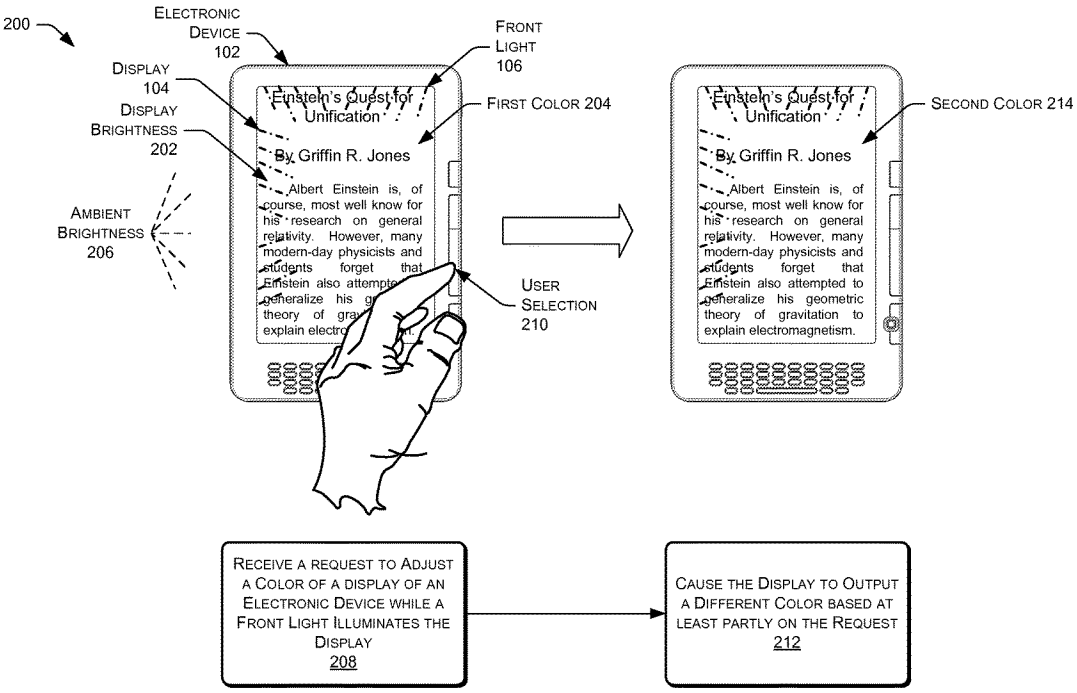
FIG. 2 illustrates an example scenario similar to the scenario of FIG. 1, although in this instance, the color output by the display may be adjusted in response to a user request.

FIG. 2 illustrates an example scenario 200 similar to the example scenario 100 of FIG. 1, although in this instance the color of the display may be adjusted based at least partly on an action taken by the user operating the electronic device 102. As illustrated in FIG. 2, the electronic device 102 may include the display 104 and the front light 106. Moreover, the display 104 may have a corresponding display brightness 202 and may be presented in a first color 204. The electronic device 102 may also be configured to detect or determine, possibly via one or more sensors, an ambient brightness 206 of an environment surrounding the electronic device 102.

As stated at step 208, the electronic device 102 may receive a request to adjust a color of the display 104 of the electronic device 102 while the front light 106 illuminates the display 104. In particular, the electronic device 102 may receive a user selection 210 with respect to the brightness (e.g., display brightness 202) and/or the color (e.g., first color 204) of the display 104 of the electronic device 102. For instance, the user selection 210 may correspond to a user input that indicates that the user would prefer to adjust the brightness and/or color of the display 104. The user selection 210 may include user interaction with respect to a button, knob, switch, slider, etc., user interaction with respect to a touch-sensitive interface, a voice command, and so on. Furthermore, the user selection 210 may be in response to a particular display brightness 202 and/or ambient brightness 206 with respect to the display 104 of the electronic device 102. That is, the user may prefer that the display, or portions thereof, be a different color.

As stated at step 212, the electronic device 102 may cause the display 104 to output a different color based at least partly on the request. That is, in response to the user selection 210, the electronic device 102 may adjust or modify the color of the display 104, such as by adjusting the first color 204 to a different, second color 214.

In other embodiments, the color of the display 104 that is determined and presented to the user may be based at least partly on the user's prior actions or behavior. For instance, the electronic device 102 may monitor and/or store colors preferred by the user, the adjustment of colors by the user, and/or colors of the display 104 when the user interacted with the electronic device 102 in different lighting conditions (e.g., display brightness 202, ambient brightness 206, etc.). As a result, the electronic device 102 (e.g., or a server) may determine and store colors of the display 104 that are likely to be preferred by the user in different contexts. Then, when the electronic device 102 determines a similar context, such as the display brightness 202 and/or the ambient brightness 206 being above, below, or equal to one or more brightness thresholds, the electronic device 102 may adjust the color of the display 104 in a similar manner. For example, if the user preferred a more bluish color of the display 104 in low lighting conditions, the electronic device 102 may automatically and/or dynamically adjust the color of the display 104 to a bluish color in similar low lighting conditions.

Figure 3:
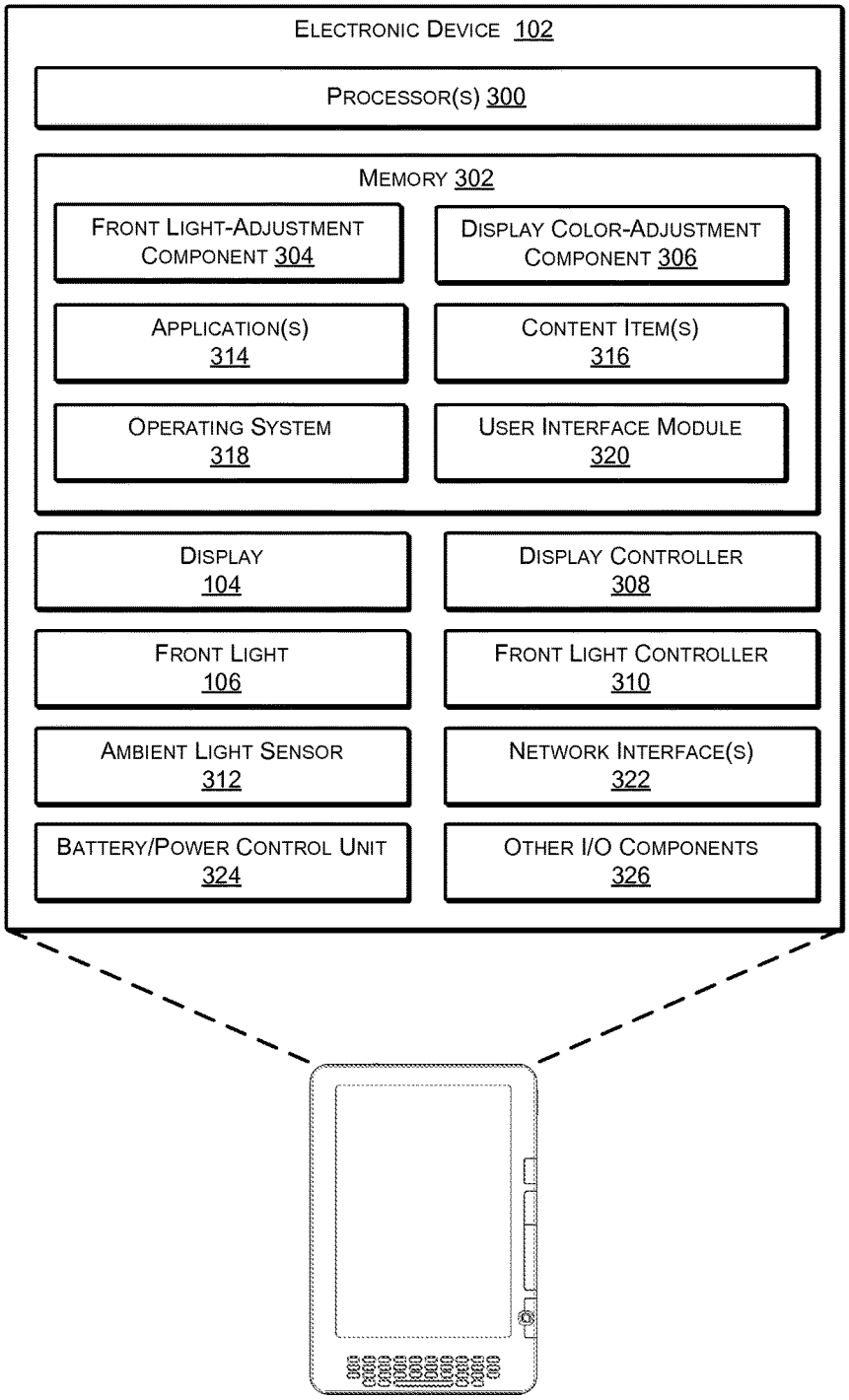
FIG. 3 illustrates example components of an electronic device configured to cause a display to output a different color.

FIG. 3 illustrates example components of an electronic device, such as electronic device 102, that is configured to adjust a color of the display of the electronic device 102. While FIG. 3 illustrates the electronic device 102 as a dedicated electronic book reading device, in other implementations, the electronic device 102 may include any other type of mobile electronic device (e.g., a laptop computer, a tablet computing device, a multifunction communication device, a portable digital assistant (PDA), etc.) or non-mobile electronic device (e.g., a desktop computer, a television, etc.).

Regardless of the specific implementation of the electronic device 102, the electronic device 102 may include one or more processors 300, a display 104, a front light 106, and memory 302. In some instances, the electronic device 102 may utilize a front light-adjustment component 304 stored in the memory 302 and executable on the processors 300 to adjust a brightness of the front light 106. In other instances, the electronic device 102 may utilize a front light-adjustment component in hardware to perform these operations. In some instances, the front light-adjustment component 304 may include a microcontroller that resides in the processor(s) 300.

The memory 302 may also store or maintain a display color-adjustment component 306. In various embodiments, the display color-adjustment component 306 may adjust or modify the color of the display 104, possibly based on the degree of brightness of the display 104 and/or the degree of brightness of the ambient environment surrounding the electronic device 102. That is, and as described in additional detail below, the display color-adjustment component 306 may determine a color of the display 104 or adjust the color of the display 104 from a first color to a second, different color.

Moreover, a display controller 308 may control the updating of the display 104, while a front light controller 310 may control the front light 106. The front light 106 may be integrated within the electronic device 102, as shown in FIG. 1. In these instances, one or more light sources (e.g., LEDs) may reside around some or all of the display 104, and may be illuminated when desired. A surface of the display 104 may include diffractive gratings (e.g., having a sawtooth cross-sectional profile) that diffracts light received across the surface of the display 104 down onto the display 104. The display 104 may then reflect the light back upwards and away from the display, thus illuminating the display 104. In other instances, the front light may detachably couple to the electronic device 102. Of course, while two examples are described herein, electronic devices may implement any other types of lights configured to light a front portion of the display 104 of the electronic device 102. Moreover, the front light controller 310, meanwhile, may include a portion of the main processing unit of the electronic device 102, or may include a separate microcontroller or driver.

In addition, the electronic device 102 may include an ambient light sensor 312 that is configured to measure the amount of ambient light in an environment surrounding the electronic device 102. In some instances, the front light-adjustment component 304 and/or the display color-adjustment component 306 may compare the measured ambient light to a threshold and may implement the front light/color adjustment techniques described herein at least partly in response to determining that the ambient light is less than a threshold (i.e., the electronic device 102 is being used in dim lighting conditions). For the purpose of this discussion, the brightness of the display and/or the brightness of the ambient environment may be referred to as brightness values.

In some instances, the display 104 may represent a type of reflective display, such as an electronic paper display, that displays content based on light reflected from above the display 104. Electronic paper displays may represent an array of display technologies that largely mimic the look of ordinary ink on paper. In contrast to conventional backlit displays, electronic paper displays typically reflect light, much as ordinary paper does. In addition, electronic paper displays are often bi-stable, meaning that these displays are capable of holding text or other rendered images even when very little or no power is supplied to the display 104.

In one implementation, the display 104 may include an electrophoretic display that moves particles between different positions to achieve different color shades. For instance, in a pixel that is free from a color filter, the pixel may be configured to produce white when the particles within this pixel are located at the front (i.e., viewing) side of the display 104. When situated in this manner, the particles reflect incident light, thus giving the appearance of a white pixel. Conversely, when the particles are pushed near the rear of the display 104, the particles absorb the incident light and, hence, cause the pixel to appear black to a viewing user. In addition, the particle may situate at varying locations between the front and rear sides of the display 104 to produce varying shades of gray. Furthermore, as used herein, a "white" pixel may comprise any shade of white or off white.

In another implementation, the display 104 may include an electrophoretic display that includes oppositely charged light and dark particles. In order to create white, the display controller 308 may move the light particles to the front side of the display 104 by applying a voltage to create a corresponding charge at an electrode near the front and moves the dark particles to the back of the display 104 by creating a corresponding charge at an electrode near the back. In order to create black, meanwhile, the display controller 308 may change the polarities and move the dark particles to the front and the light particles to the back. Furthermore, to create varying shades of gray, the display controller 308 may utilize different arrays of both light and dark particles.

In still another implementation, the display 104 may include an electrowetting display that employs an applied voltage to change the surface tension of a liquid in relation to a surface. For instance, by applying a voltage to a hydrophobic surface, the wetting properties of the surface can be modified so that the surface becomes increasingly hydrophilic. As one example of an electrowetting display, the modification of the surface tension may act as an optical switch by contracting a colored oil film when a voltage is applied to individual pixels of the display 104. When the voltage is absent, the colored oil may form a continuous film within a pixel, and the color may thus be visible to a user of the display 104. On the other hand, when the voltage is applied to the pixel, the colored oil may be displaced and the pixel may become transparent. When multiple pixels of the display 104 are independently activated, the display may present a color or grayscale image. The pixels may form the basis for a transmissive, reflective, or transmissive/reflective (transreflective) display 104. Further, the pixels may be responsive to high switching speeds (e.g., on the order of several milliseconds), while employing small pixel dimensions. Accordingly, the electrowetting displays herein may be suitable for applications such as displaying video content. In addition, the lower power consumption of electrowetting displays in comparison to conventional liquid-crystal displays (LCDs) makes the technology suitable for displaying content on portable devices that rely on battery power.

Of course, while multiple different examples have been given, it is to be appreciated that the displays 104 described herein may comprise any other type of electronic paper technology, such as gyricon displays, electrowetting displays, electrofluidic displays, interferometric modulator displays, cholestric liquid crystal displays, and the like. In addition, while some of the displays 104 described below are discussed as displaying dark (e.g., black), light (e.g., white), and varying shades of gray, it is to be appreciated that the described techniques apply equally to electronic paper displays capable of displaying color pixels.

Furthermore, while the techniques above describe the use of reflective displays and front lights, in some instances the techniques described herein may be used in backlit displays. For instance, the brightness of a backlight in a display may be altered in the same, similar or different ways as described herein with reference to a page-update on a reflective display.

As illustrated, the memory 302 may further store one or more applications 314 and one or more content items 316, as well as an operating system 318 and a user interface module 320. In some instances, one or more of the applications 314 may include content presentation applications for presenting the content items 314. For instance, an application 314 may be an electronic book reader application for rending textual electronic books, an audio player for playing audio books or songs, a video player for playing video, and so forth. Moreover, the content items 316 may include any type of content, such as eBooks, audio books, songs, videos, still images, and the like.

Furthermore, in some instances described above, the front light-adjustment component 304 and/or the display color-adjustment component 306 may reference content that is to be presented when determining how to adjust the brightness of the front light 106 and/or the color of the display 104, respectively. In these instances, the front-light adjustment component 304 and/or the display color-adjustment component 306 may determine pixel values associated with content to be presented on the display 104. In addition, the front-light adjustment component 304 may determine how to instruct the display controller 308 to adjust the color of the display 104 and how to instruct the front light controller 310 to adjust the brightness of the front light 106 based at least in part on the pixel values.

In various embodiments, the front light-adjustment component 304 and the display color-adjustment component 306 may allow users of the electronic device 102 to adjust the brightness and color, respectively, of the display 104. For instance, the electronic device 102 may allow users to interact with one or more buttons, switches, sliders, dials, knobs, etc., in order to adjust the brightness or color of the display 104. Users may also adjust the brightness or color of the display 104 via a touch-sensitive interface or via one or more voice commands. Moreover, provided that the front light 106 of the electronic device 102 includes multiple LEDs of varying colors (e.g., red, green, blue, etc.), a user may adjust each colored LED independently in order to adjust the color of the display 104. For example, the user may interact with sliders that each correspond to one of the colored LEDs, and change the color of the display 104 as a result. The user may also adjust the overall color of the display 104 utilizing one or more input mechanisms, such as a color wheel that allows the user to select the overall color of the display 104. Accordingly, the electronic device 102 may allow users to adjust the color of the display 104, the background of the display 104, or of various features depicted on the display 104 (e.g., images, text, etc.), while the front light 106 lights the display 104.

In other embodiments, the brightness and/or color of the display 104 may be determined or adjusted based at least partly on preferences of a user or data associated with the user. For instance, the user may indicate preferred colors of the display 104, which may cause the electronic device 102 to set the display 104 at those preferred colors. The user may also specify preferred colors of the display 104 at different brightness levels, which may correspond to the brightness of the display 104 and/or the brightness of the ambient environment surrounding the electronic device 102. Then, as the electronic device 102 determines the current brightness level of the display 104 and/or the current brightness level of the ambient environment, the electronic device 102 may configure the display 104 to present those preferred colors. In certain embodiments, the electronic device 102 may adjust the color of the display to a preferred color of the user in response to the brightness of the display 104 and/or the brightness of the ambient environment being greater than, equal to, or less than one or more brightness thresholds. That is, as the user adjusts the brightness of the display, or as the ambient lighting conditions change (e.g., a light is turned on/off), the electronic device 102 may adjust the color of the display 104 based on known preferences of the user.

Furthermore, the color of the display 104 for a particular user operating the electronic device 102 may be based on actions performed by that user or the behavior of the user over time. More particularly, the electronic device 102, and/or a server communicatively coupled to the electronic device 102, may determine that the user tends to adjust the display 104 to have different colors in different lighting conditions. For instance, it may be determined that the user tends to adjust the display 104 to present a different color as the brightness of the display 104 is increased or decreased. It may also be determined that the user tends to adjust the display 104 to present a different color based on the brightness of the ambient environment surrounding the electronic device 102, such as the user adjusting the color in low lighting conditions (e.g., a dark room, nighttime, etc.) and adjusting the color differently in better lighting conditions (e.g., a lighted room, daytime, etc.). Then, as the electronic device 102 determines the current brightness of the display 104 and/or the current brightness of the ambient environment surrounding the electronic device 102, the electronic device 102 may automatically and/or dynamically adjust the color of the display 104 in a manner consistent with the previous behavior exhibited by the user. The adjustment of the color may be based on the current brightness of the display 104 and/or the current brightness of the ambient environment being above, below, or equal to one or more thresholds (e.g., brightness thresholds). As a result, the electronic device 102 may adjust the color of the display 104 based on the stored preferences of the user, without the user having to worry about adjusting the color himself/herself.

Therefore, a user may desire a different color of the display 104 despite the brightness of the display 104 remaining constant and/or despite the brightness of the ambient environment surrounding the electronic device 102 remaining constant. For example, assuming that the brightness of the display 104 remains the same, the user may prefer different colors of the display 104 in different ambient lighting conditions. Similarly, despite the brightness of the ambient environment remaining the same (e.g., a lighted room), the user may prefer different colors of the display 104 as the brightness of the display 104 varies (e.g., the user increases or decreases the brightness of the display 104). The electronic device 102, and/or a server associated therewith, may infer color preferences of the user in different lighting conditions based on previous actions taken by the user or previous color settings associated with the electronic device 102, and then make those color adjustments to the display 104 in real-time or near real-time. The electronic device 104 may also confirm that the user would like to adjust the color of the display 104, such as by prompting the user to confirm that the user would in fact like to adjust the color of the display 104.

In further embodiments, the color of the display 104 may be determined and/or adjusted based on the particular user that is operating the electronic device 102. As stated above, certain users may have varying preferences regarding the brightness and/or color of the display 104 of the electronic device 102. As a result, by determining which user is currently operating the electronic device 102, the electronic device 102 may adjust the brightness/color of the display 104 based on the preferences of that particular user. In certain embodiments, there may be a single user or multiple users that use the electronic device 102. In the latter instance, the electronic device 102 may identify or authenticate the user in any manner, such as using information provided by the user (e.g., the user providing a username and/or password), facial recognition technology, fingerprint technology, a voice command, and so on. In response to identifying and/or authenticating the user that is currently using the electronic device 102, the electronic device 102 may determine and/or adjust the brightness and/or the color of the display 104 based on the preferences of the identified user.

The color of the display 104 may also be varied based on contextual information. In particular, the color of the display 104 may be adjusted based on the operations being performed by the user via the electronic device 102, a particular point of time with respect one of the content items 316, and so on. For example, the electronic device 102 may adjust the color of the display 104 depending on whether the user is reading an eBook, displaying video content (e.g., a movie), interacting with one of the applications 314, and so on. Moreover, provided that the user is interacting with one of the content items 316, the electronic device 102 may adjust the color of the display 104 based on a particular point within that content item 316 (e.g., a scary portion of an eBook, the chorus of a song, etc.).

FIG. 3 further illustrates that the electronic device 102 may include one or more network interfaces 322, one or more power sources 324 that provide power to the electronic device 102, and one or more other input/output components 326. The network interfaces 322 may support both wired and wireless connection to various networks, such as cellular networks, radio, WiFi networks, short range networks (e.g., Bluetooth), IR, and so forth.

Depending on the configuration of the electronic device 102, the memory 302 (and other computer-readable media described throughout) is an example of computer storage media and may include volatile and nonvolatile memory. Thus, the memory 302 may include, but is not limited to, RAM, ROM, EEPROM, flash memory, or other memory technology, or any other medium which can be used to store content items 316 or applications 314 and data which can be accessed by the electronic device 102.

In some instances, the electronic device 102 may have features or functionality in addition to those that FIG. 3 illustrates. For example, the electronic device 102 may also include additional data storage devices (removable and/or non-removable) such as, for example, magnetic disks, optical disks, or tape. The additional data storage media may include volatile and nonvolatile, removable and non-removable media implemented in any method or technology for storage of information, such as computer readable instructions, data structures, program modules, or other data. In addition, some or all of the functionality described as residing within the electronic device 102 may reside remotely from the electronic device 102 in some implementations. In these implementations, the electronic device 102 may utilize the network interfaces 322 to communicate with and utilize this functionality.

Various instructions, methods and techniques described herein may be considered in the general context of computer-executable instructions, such as program modules, executed by one or more computers or other devices. Generally, program modules include routines, programs, objects, components, data structures, etc. for performing particular tasks or implement particular abstract data types. These program modules and the like may be executed as native code or may be downloaded and executed, such as in a virtual machine or other just-in-time compilation execution environment. Typically, the functionality of the program modules may be combined or distributed as desired in various embodiments. An implementation of these modules and techniques may be stored on or transmitted across some form of computer readable media.

Figure 4:
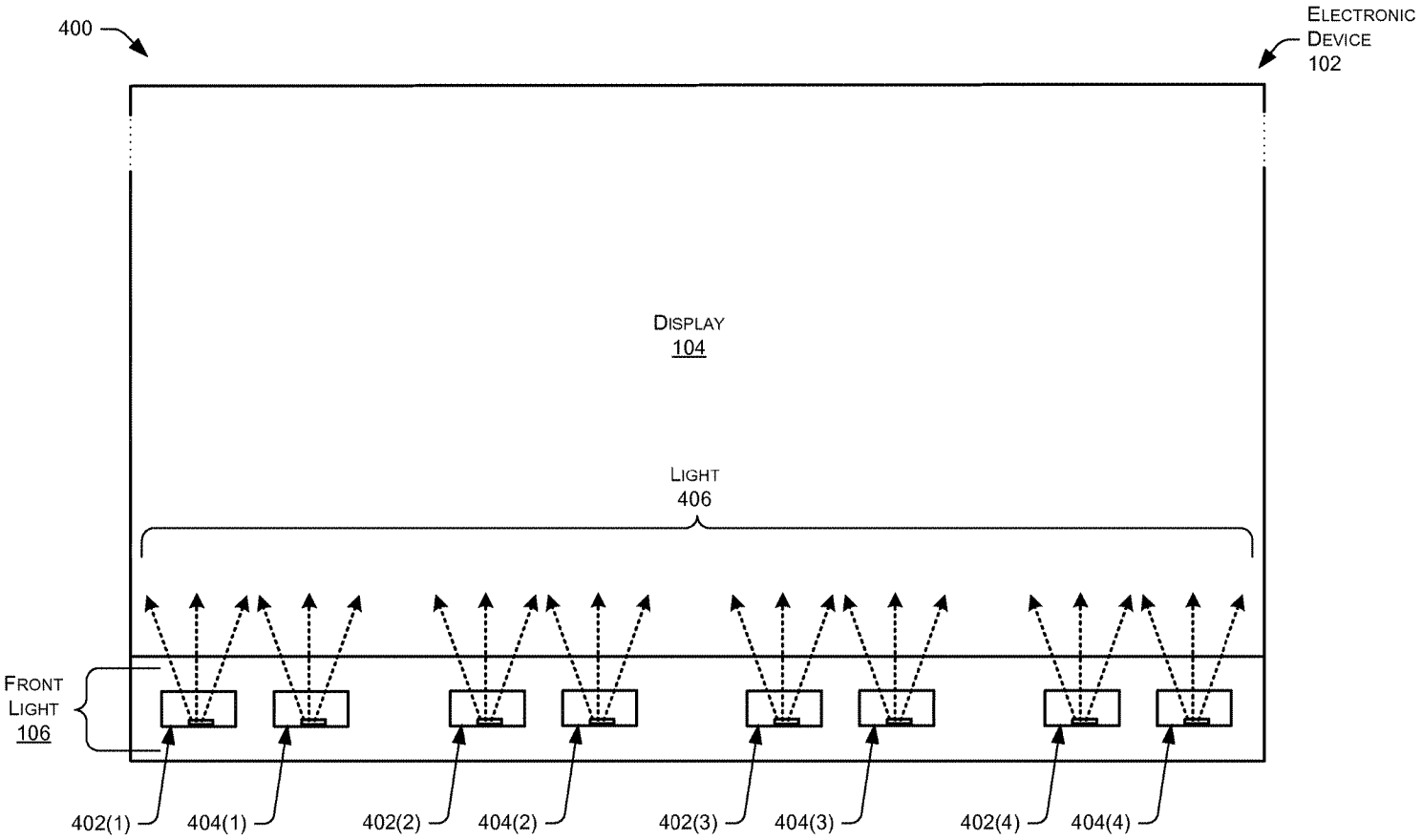
FIG. 4 illustrates an example diagram of a front light of the electronic device that is used to cause a display to output an adjusted color.

FIG. 4 illustrates an electronic device having a front light that includes one or more LEDs that are used to adjust a color of a display of the electronic device. The electronic device 102 may include a display 104 and a front light 106, which may include multiple LEDs that are used to illuminate the display 104 and to adjust the brightness and/or color of the display 104. As shown, and although any number or types of LEDs may be included within the front light 106, the front light 106 may include two types of LEDs—a first type of LEDs corresponding to 402(1)-402(4) and a second type of LEDs corresponding to 404(1)-404(4). For the purposes of this discussion, the two types of LEDs differ with respect to the color that the LEDs emit. For instance, LEDs 402(1)-402(4) may emit a bluish-colored light, while LEDs 404(1)-404(4) may emit a yellowish-colored light. However, any color LEDs may be included within the front light 106 of the electronic device 102. As illustrated in FIG. 4 the light emitted by each of the LEDs may be represented by light 406. In other embodiments, different types of LEDs may vary with respect to size, aesthetics, location on or within the electronic device, orientation with respect to the electronic device and with respect to one another, brightness, an amount of power that may be supplied thereto, and so on.

Although the LEDs may be situated in any orientation or position, the front light 106 may be designed such that the different LEDs are positioned next to one another. For instance, and as illustrated in FIG. 4, the front light 106 includes four pairs of LEDS—402(1) and 404(1), 402(2) and 404(2), 402(3) and 404(3), and 402(4) and 404(4). Situating the different LEDs in relative close proximity to one another may cause the front light 106 to emit a color on the display 104 that is a blend between the color of the first set of LEDs (i.e., 402(1)-402(4)) and the second set of LEDs (i.e., 404(1)-404(4)). Moreover, although individual LEDs are shown in FIG. 4, each LED may be a group or collection of multiple LEDs. Moreover, although the front light 106 is shown to be towards the bottom of the electronic device 102, it is contemplated that the front light 106 may be situated in any location on, above, or below the display 104. Moreover, the location of the front light 106 and the associated LEDs may influence the brightness, color, uniformity of brightness and/or color, etc., of the display 104.

In order to determine and/or adjust the color being displayed via the display 104, the electronic device 102 may adjust the relative power being supplied to multiple LEDs having intrinsically different colors. By adjusting the relative power of one or more of the multiple LEDs, the electronic device 102 may determine and/or adjust the overall average color being emitted by the multiple LEDs and being presented via the display 104. For instance, provided that the front light 106 includes two types of LEDs with each type being a different color, the color emitted via the display 104 will be a color having a wavelength that is in between the wavelength of the color associated with the first type of LED and the wavelength of the color associated with the second type of LED. By adjusting the power being supplied to one or more of the LEDs, the color of the display 104 may then be adjusted.

Alternatively, or in addition, if more than two types of LEDs are included within the front light 106, the number of colors that may be presented via the display 104 may be increased. For instance, assume that the front light 106 includes three types of LEDs that are each a different color, with each color having a corresponding wavelength. By adjusting the power being supplied to any one of the LEDs, the electronic device 102 may determine and/or adjust the color of the display 104. Here, and as described in additional detail with respect to FIG. 6, the colors that may be emitted via the display 104 will be a blend of the colors associated with the three types of LEDs.

As stated above, the front light 106 illustrated in FIG. 4 may include two different types of LEDs (i.e., 402(1)-402(4) and 404(1)-404(4)), which may include a first type of LEDs having a first color and corresponding wavelength, and a second type of LEDs having a different, second color and a different, corresponding wavelength. For the purposes of FIG. 4, although the LEDs may be any color, assume that the first type of LEDs 402(1)-402(4) are of a bluish color (e.g., blue LEDs) and the second type of LEDs 404(1)-404(2) are of a yellowish color (e.g., yellow LEDs).

In the above embodiments, the display 104 of the electronic device 102 may emit a particular color based at least partly on the amount of power that is being supplied to the LEDs. More particularly, the display 104 may have a more bluish color if the blue-colored LEDs 402(1)-402(4) are powered on and the yellow-colored LEDs 404(1)-404(4) are powered off. Similarly, the display 104 may have a more yellowish color if the yellow-colored LEDs 404(1)-404(2) are powered on and the blue-colored LEDs 402(1)-402(4) are powered off. The display 104 may also emit a color that is a mixture of the colors associated with the two types of LEDs if they are both powered on to at least some degree. That is, the color emitted by the display 104 may between the bluish-color emitted by the blue-colored LEDs 402(1)-402(4) and the yellowish-color emitted by the yellow-colored LEDs 404(1)-404(2). As a result, if the blue-colored LEDs 402(1)-402(4) are receiving more power than the yellow-colored LEDs 404(1)-404(2), the display 104 may appear to be more bluish in color, and vice versa.

As a result, the electronic device 102 may adjust the color of the display 104 by adjusting the amount of power that is being supplied to the blue-colored LEDs 402(1)-402(4) and the yellow-colored LEDs 404(1)-404(2). That is, if it is desired to have the display 104 be more blue in color, the electronic device may increase the amount of power being supplied to the blue-colored LEDs 402(1)-402(4) and/or decrease the amount of power being supplied to the yellow-colored LEDs 404(1)-404(2). Likewise, if it is desired to have the display 104 be more yellow in color, the electronic device may decrease the amount of power being supplied to the blue-colored LEDs 402(1)-402(4) and/or increase the amount of power being supplied to the yellow-colored LEDs 404(1)-404(2). Therefore, the color of the display 104 may be adjusted by adjusting the amount of power being supplied to one of the types of LEDs, while the amount of power being supplied to the other type of LEDs may remain constant or may be adjusted in the opposite direction. Moreover, a combination of the two types of LEDs, may result in the display 104 having a more whitish color, which may be caused by supplying a relatively equal amount of power to each type of LEDs.

As mentioned above, the color of the display 104 may be determined or adjusted by supplying or adjusting the amount of power being provided to the LEDs. The amount of power being supplied to the LEDs may be determined by measuring or monitoring an amount of current flowing through the LEDs, which may be performed utilizing one or more circuits. In some embodiments, the amount of current being supplied to the LEDs may be approximately proportional to the brightness and/or the intensity of color of the LEDs.

In some embodiments, to determine or adjust the color of the display 104, the electronic device 102 may initially determine a digital value that indicates an amount of current flowing through one or more LEDs. When the color is to be adjusted by either a user or the electronic device 102, the digital value may be converted into an analog value, which may correspond to a particular voltage. Such a conversion may be performed by a digital/analog converter included within the electronic device 102. The voltage may then be passed through an analog circuit that may control the amount of current that is supplied to the LEDs. A particular amount of current may then be passed to the LEDs. If a user or the electronic device 102 wishes to adjust the color of the display 104, such as by the user generally adjusting the overall color of the display 104 or by the user adjusting individual ones of the colors associated with the LEDs, the digital value may be adjusted, which may cause a different amount of current to be supplied or passed to the LEDs. The adjusted amount of current may result in a different color being presented via the display 104.

Figure 5:
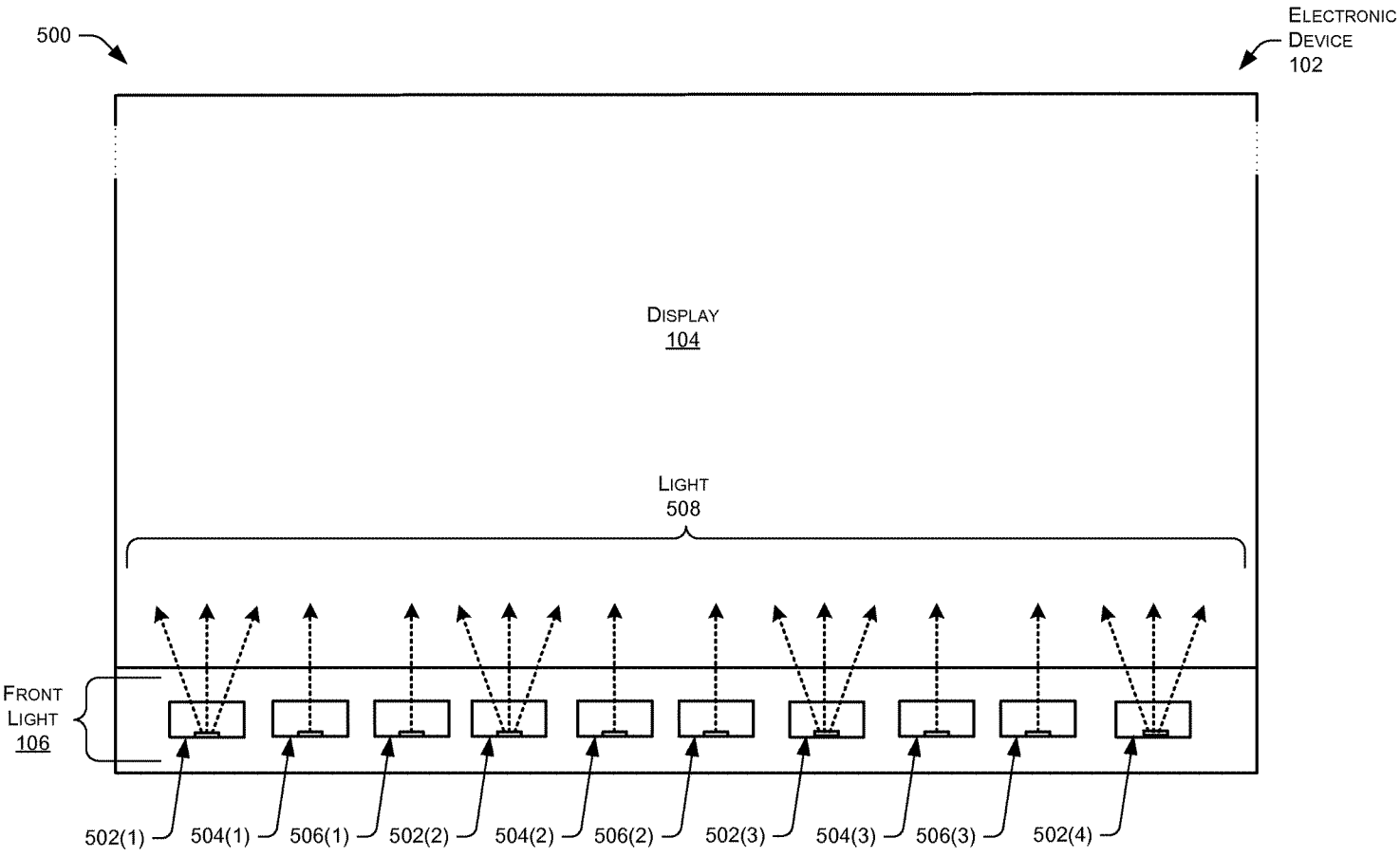
FIG. 5 illustrates a different example diagram of a front light of the electronic device that is used to cause a display to output an adjusted color.

FIG. 5 illustrates an electronic device having a front light that includes one or more LEDs that are used to adjust a color of a display of the electronic device. Similar to the electronic device 102 illustrated in FIG. 4, the electronic device 102 may include a display 104 and a front light 106, which may include multiple LEDs that are used to illuminate the display 104 and to adjust the brightness and/or color of the display 104. Instead of the front light 106 including two different types of LEDs, as illustrated in FIG. 4, the front light 106 shown in FIG. 5 may include three different types of LEDs (e.g., 502(1)-502(4), 504(1)-504(4), and 506(1)-506(4)). Each of the different types of LEDs may correspond to a different color having a different corresponding wavelength. Moreover, the light emitted from the LEDs may be represented as light 508.

In various embodiments, users may prefer to have the display 104 of the electronic device 102 emit a white-colored light. In order to cause the display 104 to emit a white-colored light, the LEDs illustrated in FIG. 5 may include white LEDs (WLEDs) that generate a high-intensity white light. The electronic device 102 may also cause display of white-colored light via the display 104 by using a phosphor material to convert monochromatic light from a blue or ultraviolet (UV) LED to a broad-spectrum white light. The display 104 may also present a white-colored light by utilizing individual LEDs, or groups/collections of LEDs, that emit three primary colors—red, green, and blue—and then mix those three colors to form a white-colored light.

FIG. 5 illustrates the scenario where the front light 106 includes red-colored LEDs (504(1)-504(4)), green-colored LEDs (506(1)-506(4)), and blue-colored LEDs (502(1)-502(4)). By determining/adjusting the power being supplied to the LEDs, the electronic device 102 may cause the display 104 to emit a particular color. For instance, a combination of the red-colored LEDs (504(1)-504(4)), the green-colored LEDs (506(1)-506(4)), and the blue-colored LEDs (502(1)-502(4)) may cause the display 104 to emit a white color. Moreover, the adjusting the power to any one of the LEDs, the electronic device 102 may cause the display 104 to emit a more red, green, or blue color. For example, by supplying power to the blue-colored LEDs (502(1)-502(4)), while powering off the red-colored LEDs (504(1)-504(4)) and the green-colored LEDs (506(1)-506(4)), a bluish-color will be displayed by the display 104. The same can be said when the red-colored LEDs (504(1)-504(4)) or the green-colored LEDs (506(1)-506(4)) are powered, while the other two LEDs are powered off, or are at least being supplied with a relatively low amount of power. Moreover, and as stated above, based on the power being provided to the LEDs, the display 104 may present a color that is a mixture of the light being emitted by the LEDs.

Therefore, by adding multiple different types of LEDs to the front light 106 of the electronic device 102, the display 104 may be presented in a variety of colors. For instance, assuming that the front light 106 only included the blue-colored LEDs (502(1)-502(4)), the electronic device 102 may be limited to presenting a bluish-color via the display 104. However, by adding red-colored LEDs (504(1)-504(4)) and the green-colored LEDs (506(1)-506(4)), the display 104 may be presented with a more white, yellow, or orange color, which may be more aesthetically pleasing to the user. Furthermore, although the LEDs are shown in a particular orientation with respect to the electronic device 102 and with respect to one another, it is contemplated that the LEDs may be situated in multiple locations on the electronic device 102 and the manner in which the LEDs are ordered may vary.

In certain embodiments, rather than the front light 106 including red, green, and blue LEDs, the front light 106 may instead include red, green, and blue white LEDs. That is, the previously mentioned blue LEDs may be substituted for blue white LEDs. Such a design may allow the display 104 to emit a variety of colors and may also allow the electronic device 102 to be more energy efficient. As stated above with respect to FIG. 5, the power supplied to one or more of the LEDs may be adjusted in order to determine/adjust a color of the display 104.

Figure 6:
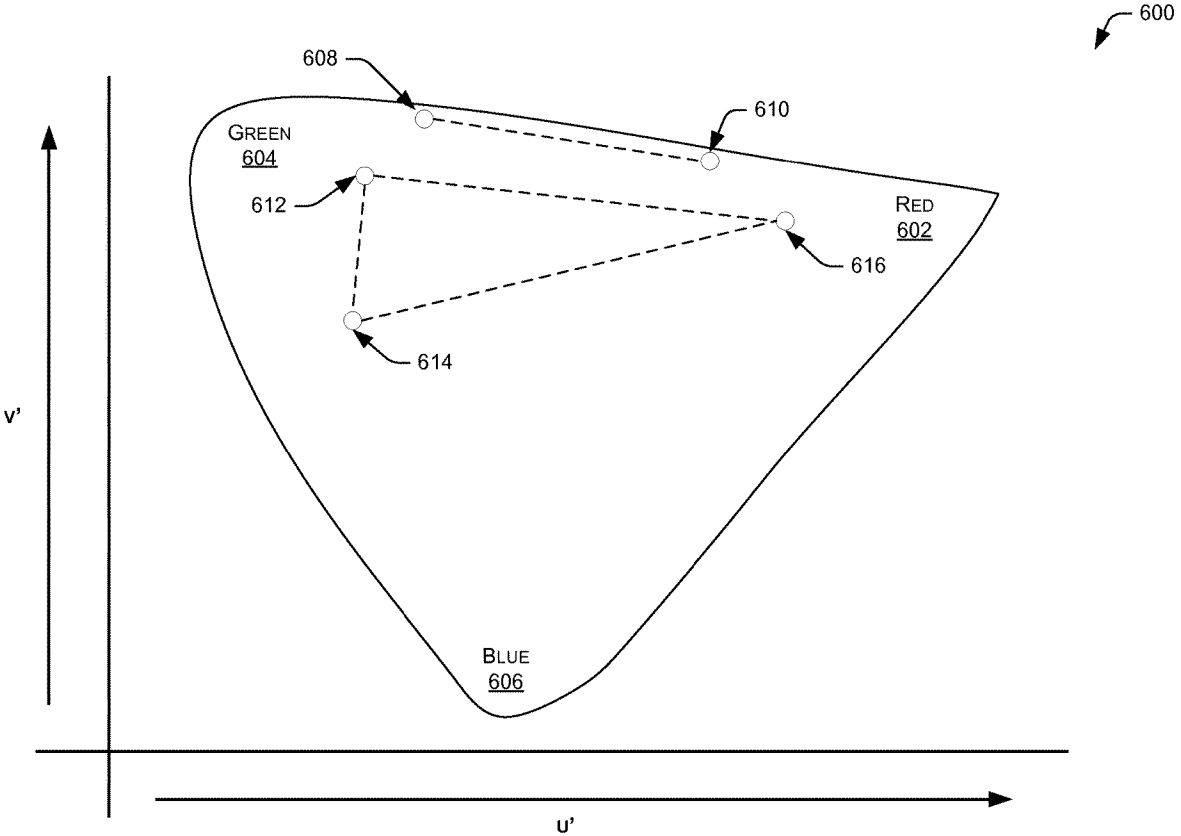
FIG. 6 illustrates a chromaticity diagram that depicts available colors that may be used to cause the display of the electronic device to output a different color.

FIG. 6 illustrates an example chromaticity diagram 600 that includes representations of LEDs that are included within the front light 106 of the electronic device 102. For the purposes of this discussion, chromaticity may refer to an objective specification of the quality of a color, regardless of the luminance of the color. In various embodiments, chromaticity may include at least two independent parameters, which may be referred to as hue and colorfulness. The v' and u' depicted in FIG. 6 may correspond to the chromaticity of a particular color. Moreover, the chromaticity diagram 600 may illustrate the range of colors displayable via the display 104 of the electronic device 102 in view of the one or more types of LEDs that are included within the front light 106.

As shown in FIG. 6, the chromaticity diagram 600 includes the three primary colors, red 602, green 604, and blue 606. The chromaticity diagram 600 also includes representations of LEDs that may be incorporated into the front light 106 of the electronic device 102, and their corresponding colors based on their wavelength. The LEDs represented by 608 and 610 may correspond to LEDs included within the front light 106 of the electronic device 102 illustrated in FIG. 4. As mentioned above, the electronic device 102 shown in FIG. 4 has two different types of LEDs. In FIG. 6, the LEDs corresponding to 608 may correspond to green LEDs and the LEDs corresponding to 610 may correspond to red LEDs. The dashed line between LEDs 608 and 610 may represent the range of colors that are available as a result of light emitted by LEDs 608 and 610 onto the display 104. That is, the colors associated with the wavelengths on the dashed line between 608 and 610 may be presented via the display 104 by determining or adjusting the power being supplied to LEDs 608 and/or 610. For instance, if the power supplied to the green LED is increased, the color associated with the display 104 would appear to be a greener color, and vice versa.

Moreover, 612-616 may represent three LEDs included within the front light 106 of the electronic device 102 illustrated in FIG. 5. In particular, 612 may correspond to a green LED, 614 may correspond to a blue LED, and 616 may correspond to a red LED. Similar to the dashed line between LEDs 608 and 610, the dashed triangle connecting LEDs 612-616 may represent the range of colors that are available as a result of the red, green, and/or blue LEDs 612-616 emitting light onto the display 104. That is, by determining or adjusting the power supplied to any one of LEDS 612-616, the electronic device 102 may cause the display 104 to present any color included in the area within the dashed triangle depicted in FIG. 6. For example, by increasing the amount of power supplied to the red LED 616, the electronic device 102 may cause the display 104 to present a color that has a wavelength that is situated closer to the corner of the dashed triangle that is in proximity to the red LED 616. By supplying a similar amount of power to each of the LEDs 612-616, the electronic device 102 may cause the display 104 to present a white color, which is an approximate area towards the center of the dashed triangle illustrated in FIG. 6.

Figure 7:
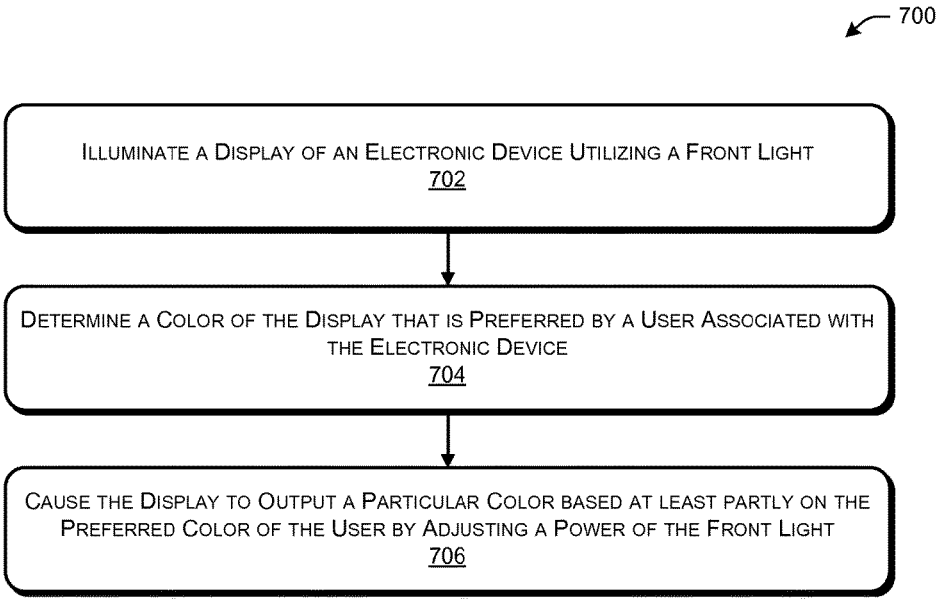
FIG. 7 illustrates a flow diagram for causing the display of the electronic device to output a different color by adjusting a power of the front light.
Figure 8:
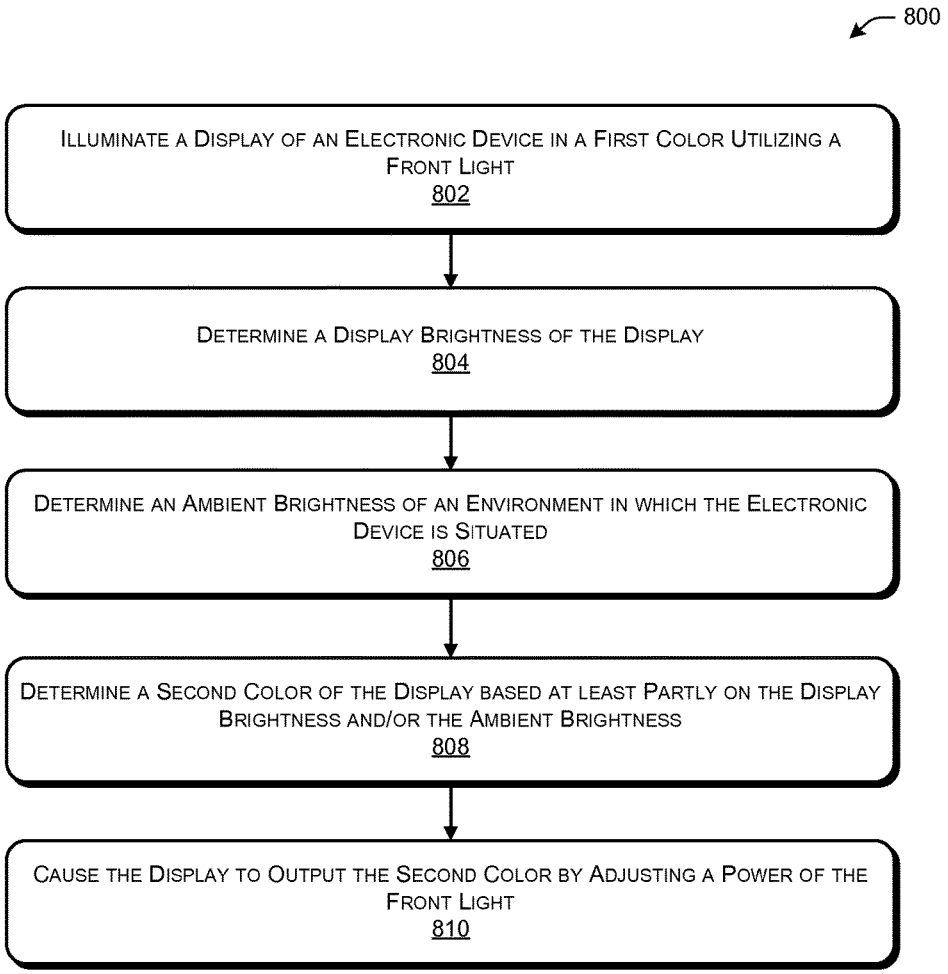
FIG. 8 illustrates a flow diagram for causing the display of the electronic device to output a different color based at least partly on a display brightness of the display and/or an ambient brightness of an environment associated with the electronic device.

FIGS. 7 and 8 illustrate example processes of adjusting a color of a display of an electronic device. These processes (as well as each process described herein) are illustrated as logical flow graphs, each operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the process.

FIG. 7 illustrates a flow diagram of an example process 700 of determining or adjusting a color of a display of an electronic device based on one or more preferences of a user. Moreover, the following actions described with respect to FIG. 7 may be performed by an electronic device, such as electronic device 102, and/or a server communicatively coupled to the electronic device 102.

Block 702 illustrates illuminating a display of an electronic device utilizing a front light. In various embodiments, the front light 106 of the electronic device 102 may illuminate the display 104, thus allowing a user of the electronic device to view content items 316 presented via the display 104. The display 104 may be lit using one or more LEDs included within the front light 106, where the LEDs may include any number of different types of LEDs, and where the different types of LEDs may correspond to different colors (e.g., red, green, blue, etc.).

Block 704 illustrates determining a color of the display that is preferred by a user associated with the electronic device. As stated above, different users may prefer that the display 104 be presented in different colors, and the preferred color of the display 104 may vary based on the brightness of the display 104 and/or the brightness of the ambient environment surrounding the electronic device 102. Color preferences of a particular user may be determined by the user providing input regarding colors that the user does or does not prefer. The electronic device 102, or a server communicatively coupled to the electronic device 102, may determine colors that are likely to be preferred by the user. This may be determined by monitoring the colors of the display 104 that are set or adjusted by the user, and the manner in which the user adjusts the color of the display 104 in different lighting conditions. The different lighting conditions may include the user adjusting the brightness of the display 104 and/or the varying brightness of the ambient environment (e.g., low or high lighting conditions).

Block 706 illustrates causing the display to output a particular color based at least partly on the preferred color of the user by adjusting a power of the front light. More particularly, based on the color preferences of the user, the electronic device 102 may adjust the color of the display 104, which may be based on the brightness of the display 104 and/or the ambient environment. The electronic device 102 may adjust the color of the display 104 by adjusting the power (e.g., current) being supplied to one or more of the LEDs residing within the front light 106 of the electronic device 102. As a result, the electronic device 102 may cause the display 104 to present a color that is aesthetically pleasing and/or preferable to the user of the electronic device 102.

FIG. 8 illustrates a flow diagram of an example process 800 of determining or adjusting a color of a display of an electronic device based on a brightness of the display and/or a brightness of the ambient environment surrounding the electronic device. Moreover, the following actions described with respect to FIG. 8 may be performed by an electronic device, such as electronic device 102, and/or a server communicatively coupled to the electronic device 102.

Block 802 illustrates illuminating a display of an electronic device in a first color utilizing a front light. As stated above, the electronic device 102 may include a front light 106 that may include one or more LEDs that emit light in order to illuminate the display 104 of the electronic device 102. Moreover, the color of the display 104 may be referred to as a first color.

Block 804 illustrates determining a display brightness of the display. In various embodiments, the electronic device 102 may determine a degree of brightness of the display 104, which may be based on the front light 106 lighting the display 104. The brightness of the display 104 may be set by the electronic device 102 and/or adjusted by the user. For instances, in lower lighting conditions, the user may prefer to increase the brightness of the display 104, while in better lighting conditions, the user may decrease the brightness of the display 104.

Block 806 illustrates determining an ambient brightness of an environment in which the electronic device is situated. In various embodiments, the electronic device 102 may include one or more sensors that are configured to detect the brightness of the ambient environment surrounding the electronic device 102. For instance, the electronic device 102 may determine that the surrounding environment is bright (e.g., daytime, a lighted room, etc.), dark (e.g., nighttime, a dark room, etc.), or somewhere in between.

Block 808 illustrates determining a second color of the display based at least partly on the display brightness and/or the ambient brightness. More particularly, since different colors of the display 104 may be preferred or may be more aesthetically pleasing in different lighting conditions, the electronic device 102 may determine a second color to be presented via the display 104 in view of the brightness of the display 104 and/or the brightness of the ambient environment. Determining the second color may also be based on explicit preferences of the user or inferred preferences of the user, which may be based on the user's behavior with respect to the brightness and/or color of the display 104 over time.

Block 810 illustrates causing the display to output the second color by adjusting a power of the front light. In various embodiments, the electronic device 102 may adjust the color of the display 104 by adjusting the power being supplied to one or more LEDs included within the front light 106 of the electronic device 102. As a result, the electronic device 102 may automatically and/or dynamically adjust the color of the display 104 based on the current brightness of the display 104 and/or the ambient environment surrounding the electronic device 102.

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A method comprising:

displaying first content from an electronic book (eBook) via an electronic paper display of an eBook reader device;

causing a plurality of front lights of the eBook reader device to illuminate the electronic paper display to cause at least some of the first content to appear in an initial color, the plurality of front lights including light-emitting diodes (LEDs) having a first LED that emits a first color of light and a second LED that emits a second, different color of light;

determining, by the eBook reader device, a first display brightness value of the electronic paper display based on an extent to which the plurality of front lights illuminate the electronic paper display;

measuring, by the eBook reader device, a first ambient brightness value that indicates an amount of incident light associated with the eBook reader device;

receiving input via one or more input components associated with the eBook reader device;

determining, based at least partly on the input, one or more preferences of a user associated with the eBook reader device, the one or more preferences indicating a preferred color with which to display content on the electronic paper display, wherein the input indicates that the preferred color is used to display content based on at least one of a determined display brightness value of the electronic paper display or a measured ambient brightness value associated with the eBook reader device; and adjusting, by the eBook reader device, an output of the plurality of front lights to cause the at least some of the first content to appear in a second color that is a variation of the initial color based at least partly on the one or more preferences and at least one of the first display brightness value or the first ambient brightness value.

2. The method as recited in claim 1, wherein:

receiving the input comprises receiving, at a prior time, a prior user adjustment of a color of second content displayed via the electronic paper display, wherein the color was displayed on the electronic paper display at a second brightness value or while the eBook reader device was associated with a second ambient brightness value;

the determining the one or more preferences of the user is based at least in part on the prior user adjustment of the color of the second content; and the adjusting of the output of the plurality of front lights is caused at least partly by a determination that the second display brightness value is within a threshold range of a display brightness value specified in the one or more preferences or the second ambient brightness value is within a threshold range of an ambient brightness value specified in the one or more preferences.

3. The method as recited in claim 1, wherein the adjusting further comprises adjusting an amount of current being supplied to at least one of the first LED or the second LED.

4. The method as recited in claim 3, wherein the first LED corresponds to a red LED, the second LED corresponds to a green LED, and a third type of LED of the LEDs corresponds to a blue LED, and wherein the adjusting further comprises adjusting the amount of current being supplied to at least one of the red LED, the green LED, or the blue LED.

5. An electronic device comprising:

one or more processors;

memory;

a display;

a plurality of light sources to illuminate the display;

one or more light sensors to:

determine a display brightness value that indicates an extent to which the plurality of light sources illuminate the display; and measure an ambient brightness value that indicates an amount of incident light associated with the electronic device; and one or more components stored in the memory and executable by the one or more processors to perform operations to:

determine, at a prior time, a prior user adjustment of a prior color illuminated on the display, wherein the prior color was illuminated on the display at a prior brightness value or while the electronic device was associated a prior ambient brightness value at the prior time;

determine, based at least in part on the prior user adjustment of the prior color, one or more preferences of a user associated with the electronic device, the one or more preferences indicating a preferred color with which to display content on the display, wherein the preferred color is determined based on at least one of the display brightness value or the ambient brightness value; and select a color to be illuminated on the display based at least partly on light from the plurality of light sources, wherein the operations to select the color are based at least partly on at least one of the display brightness value or the ambient brightness value, and the one or more preferences.

6. The electronic device as recited in claim 5, wherein the one or more components are further executable by the one or more processors to perform operations to cause a second color that is a variation of the color to be illuminated on the display based on light from the plurality of light sources.

7. The electronic device as recited in claim 5, wherein the plurality of light sources further comprises multiple light-emitting diodes (LEDs), and wherein the operations to select the color are based on an amount of power being supplied to at least one of the multiple LEDs.

8. The electronic device as recited in claim 7, wherein the one or more components are further executable by the one or more processors to perform operations to cause a second color different from the color to be illuminated on the display based on light from the plurality of light sources by varying the amount of power being supplied to at least one of the multiple LEDs.

9. The electronic device as recited in claim 7, wherein the multiple LEDs include a red LED, a green LED, and a blue LED, and wherein the color is based on a mixture of light emitted by one or more of the red LED, the green LED, and blue LED.

10. The electronic device as recited in claim 5, wherein the one or more components are further executable by the one or more processors to store the one or more preferences on a server communicatively coupled to the electronic device.

11. The electronic device as recited in claim 5, wherein the one or more components are further executable by the one or more processors to perform operations to:

determine whether the display brightness value meets or exceeds a display brightness threshold;

determine whether the ambient brightness value meets or exceeds an ambient brightness threshold; and in response to at least one of determining that the display brightness value meets or exceeds the display brightness threshold or determining that the ambient brightness value meets or exceeds the ambient brightness threshold, cause a second color different from the color to be illuminated on the display based on light from the plurality of light sources.

12. The electronic device as recited in claim 5, wherein the one or more components are further executable by the one or more processors to perform operations to:

prompt the user for confirmation to adjust the color.

13. The electronic device as recited in claim 5, wherein the one or more components are further executable by the one or more processors to determine that the one or more preferences comprise data indicating one or more colors that the user does not prefer.

14. The electronic device as recited in claim 5, wherein the plurality of light sources include one or more front lights, and wherein the display is a reflective display.

15. The electronic device as recited in claim 5, wherein the plurality of light sources include one or more back lights, and wherein the display is a transmissive display or a liquid crystal display.

16. A method comprising:

determining, by an electronic device, user data with respect to colors that can be illuminated on a display of the electronic device based on light from a plurality of light sources of the electronic device;

determining, by the electronic device, a display brightness value corresponding to a level of brightness of the display caused by the light from the plurality of light sources;

determining, based at least partly on the user data and the display brightness value, a color to be illuminated on the display; and causing, by the electronic device, the color to be illuminated on the display.

17. The method as recited in claim 16, wherein the plurality of light sources includes multiple light-emitting diodes (LEDs), and wherein the causing the color to be illuminated on the display further comprises determining an amount of power being supplied to the multiple LEDs.

18. The method as recited in claim 16, wherein the user data includes at least one of a user request for the color or user-provided input regarding preferred colors that can be illuminated on the display.

19. The method as recited in claim 16, further comprising:

determining, by the electronic device, an ambient brightness value that indicates an amount of incident light associated with the electronic device;

determining that a user of the electronic device previously adjusted a setting of the electronic device to cause a particular color being illuminated on the display to be adjusted to the color when display brightness values of the light from the plurality of light sources met or exceeded a display brightness threshold; and determining whether the display brightness value meets or exceeds the display brightness threshold, wherein, the causing further comprises causing the color to be illuminated on the display at least partly in response to determining that the display brightness value meets or exceeds the display brightness threshold.

20. The method as recited in claim 16, further comprising:

determining, by the electronic device, an ambient brightness value that indicates an amount of incident light associated with the electronic device;

determining that a user of the electronic device previously adjusted a setting of the electronic device to cause a particular color being illuminated on the display to be adjusted to the color when ambient brightness values met or exceeded an ambient brightness threshold; and determining whether the ambient brightness value meets or exceeds the ambient brightness threshold, wherein, the causing further comprises causing the color to be illuminated on the display at least partly in response to determining that the ambient brightness value meets or exceeds the ambient brightness threshold.

21. The method as recited in claim 16, wherein the user data includes user-provided input regarding preferred colors to be illuminated on the display at different display brightness values of the light from the plurality of light sources or at different ambient brightness values of incident light associated with the electronic device.

22. The method as recited in claim 16, further comprising:

determining, by the electronic device, an ambient brightness value that indicates an amount of incident light associated with the electronic device;

determining a change in at least one of the display brightness value or the ambient brightness value; and causing an adjustment of the color to be illuminated on the display to a second color that is a variation of the color based at least partly on the change.

* * * * *